US005163547A

United States Patent [19]

Hsieh

[11] Patent Number: 5,163,547

[45] Date of Patent: Nov. 17, 1992

[54] PORTABLE EASEL SUITCASE

[75] Inventor: Henry Hsieh, Taipei, Taiwan

[73] Assignee: Traxon Corporation, Taipei, Taiwan

[21] Appl. No.: 821,163

[22] Filed: Jan. 13, 1992

[51] Int. Cl.[5] ..... B05C 17/00

[52] U.S. Cl. ..... 206/1.7; 206/45.28; 206/371; 206/561; 220/532; 220/533

[58] Field of Search ..... 206/1.7, 45.13, 45.2, 206/45.28, 224, 371, 372, 373, 561; 220/532, 533, 345; 190/102, 110

[56] References Cited

U.S. PATENT DOCUMENTS

| | | | |
|---|---|---|---|
| 1,614,910 | 1/1927 | Yarder | 206/373 |
| 1,799,373 | 4/1931 | Clark | 206/371 |
| 2,019,083 | 10/1935 | Loftin | 206/373 |
| 2,648,933 | 8/1953 | Brooks et al. | 206/1.7 |
| 2,868,364 | 1/1959 | Helser | 206/45.2 |
| 2,940,200 | 6/1960 | Endlich | 206/1.7 |
| 3,284,927 | 11/1966 | Milne | 206/1.7 |
| 4,061,224 | 12/1977 | Fuhri | 206/1.7 |
| 4,340,140 | 7/1982 | Wilcox et al. | 206/373 |
| 4,475,650 | 10/1984 | De Fazio, Jr. | 206/224 |
| 4,616,748 | 10/1986 | Thomas et al. | 206/1.7 |
| 5,011,013 | 4/1991 | Meisner et al. | 206/373 |
| 5,014,850 | 5/1991 | Huff | 206/1.7 |

FOREIGN PATENT DOCUMENTS

| | | | |
|---|---|---|---|
| 485025 | 5/1938 | United Kingdom | 206/45.28 |

*Primary Examiner*—David T. Fidei
*Attorney, Agent, or Firm*—Notaro & Michalos

[57] ABSTRACT

A portable easel suitcase comprising a casing which is preferably a parallelepiped with an opening closed by a removable flat lid. A shallow pan-like, rectangular tool holder, for receiving therein painting tools, is disposed inside the casing in such a way to form an interspace therebetween so as to interpose pieces of drawing paper therebetween. A plurality of supporting slots are formed on the casing to support the flat lid in an inclined position for serving as a painting board. A handle may also attached on the casing for carrying the portable easel suitcase.

6 Claims, 4 Drawing Sheets

PORTABLE EASEL SUITCASE

FIELD OF THE INVENTION

The invention relates generally to a portable suitcase inside which a plurality of painting tools can be disposed for outdoor paintings and in particular to such a suitcase which is convertible into an easel.

BACKGROUND OF THE INVENTION

It usually requires many kinds of tool in doing a painting. This constitutes no problem when people are doing paintings indoors. However, it is quite inconvenient to prepare and carry those painting tools outdoors for doing paintings in an outdoor environments. It is desirable to have a device which is compact and easy to carry to handle the painting tools when people are travelling and doing paintings outdoors. Furthermore, it is also desirable to have storing means to store the painting tools when the tools are not used.

OBJECTS OF THE INVENTION

It is therefore an object of the present invention to provide a portable easel suitcase which is convertible into an easel.

It is another object of the present invention to provide a portable easel suitcase inside which painting tools can be disposed for carrying outdoors.

It is a further object of the present invention to provide a portable easel suitcase which is used to store painting tools not in use.

It is a further object of the present invention to provide a portable easel suitcase which is convertible into an easel.

It is a further object of the present invention to provide a portable easel suitcase which is convertible into a black board or a white board.

To achieve the above-mentioned objects, there is provided a portable easel suitcase comprising a casing which is preferably a parallelepiped with an opening closed by a removable flat lid which constitutes a drawing board. A shallow pan-like, rectangular tool holder, for receiving therein painting tools, is disposed inside the casing in such a way to form an interspace therebetween so as to interpose pieces of drawing paper therebetween. A plurality of supporting slots are formed on the casing to support the flat lid in an inclined position for serving as an easel. A handle may also attached to the casing for carrying the ease suitcase.

Other objects and advantages of the invention will be apparent from the following description of the preferred embodiment taken in connection with the accompanying drawing wherein:

DETAILED DESCRIPTION OF THE PREFERRED EMBODIMENT

Figure 1:
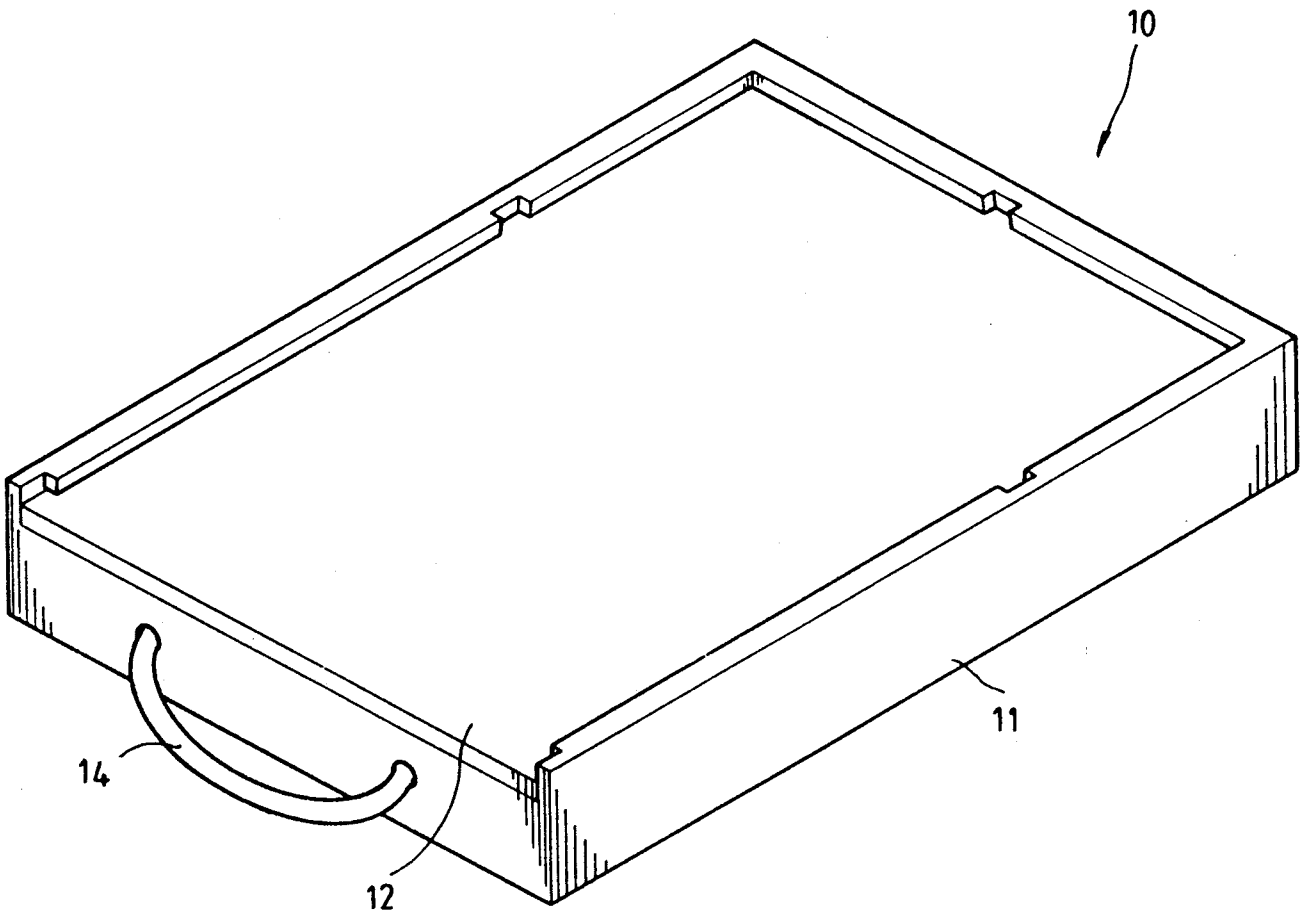
FIG. 1 is a perspective view of a portable easel suitcase in accordance with the present invention when closed by the removable lid thereof.
Figure 2:
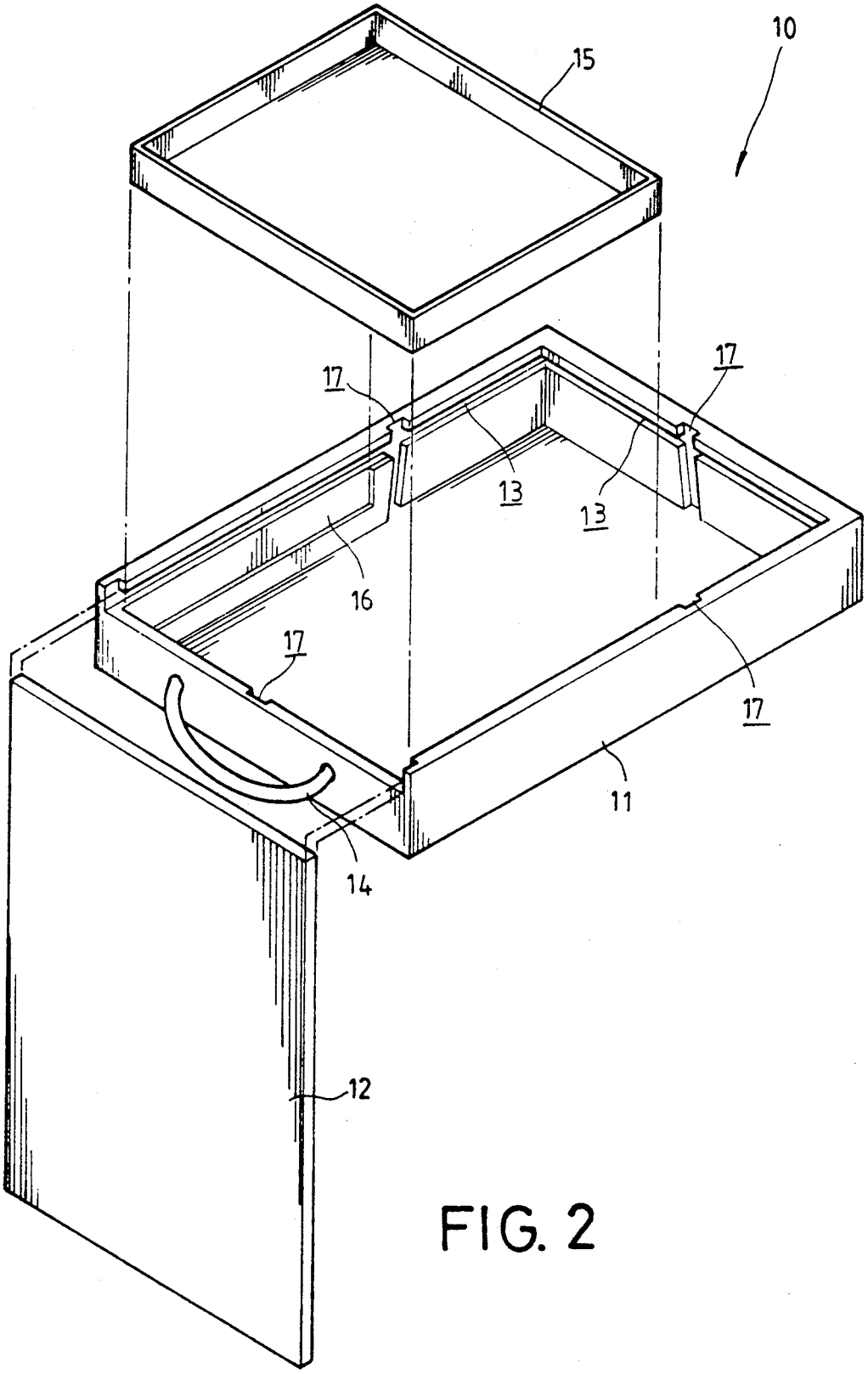
FIG. 2 is an exploded fragmental view of the portable easel suitcase shown in FIG. 1.

With reference to the drawings and in particular to FIGS. 1 and 2, a portable easel suitcase in accordance with the present invention, generally designated with the reference numeral 10, comprises a casing 11, preferably in the form of a parallelepiped. The parallelepiped casing 11 has a first dimension much less than a second and a third dimensions thereof which define a top and a bottom sides, opposing each other, of the casing 11. lateral sides of the casing 11 being secured and connected therebetween to form the casing 11. The top side of the casing 11 is opened to receive therein pieces of drawing paper (not shown) and is closable with a removable flat lid 12. Guiding means, such as slot 13, is formed on the circumference of the top side to guide the movement of the removable lid 12. A handle 14 is also attached to the casing 11 for carrying the portable easel suitcase 10.

The removable lid 12 can serve as a painting board made of a suitable material. The lid 12 may be made of a transparent material, such as acrylic, to serve as means for duplicating drawings or it may be coated with a smooth surface to serve as a black board for chalks or a white board for oilbased marking pens (not shown).

The portable easel suitcase 10 of the present invention further comprises a shallow pan-like, rectangular tool holder 15 which is sized in such a way that it is insertable inside the casing 11 and supported and spaced from the bottom of the casing 11 by steps 16 (only one is shown in the drawings) respectively formed on two of the lateral sides that are opposing each other so that the pieces of drawing paper is interposed therebetween. Preferably, the tool holder 15 has a height about half of the internal height of the casing 11 and the steps 16 are formed halfway of the internal height of the casing 11. It is also preferable for the tool holder 15 to have a length about half of the internal length of the casing 11 so as not to fully cover the bottom of the casing 11. Painting tools (not shown) are placed in the tool holder 15 and will be kept therein during travelling because of the compactability in dimensions of the casing 11 and the tool holder 15.

Figure 3:
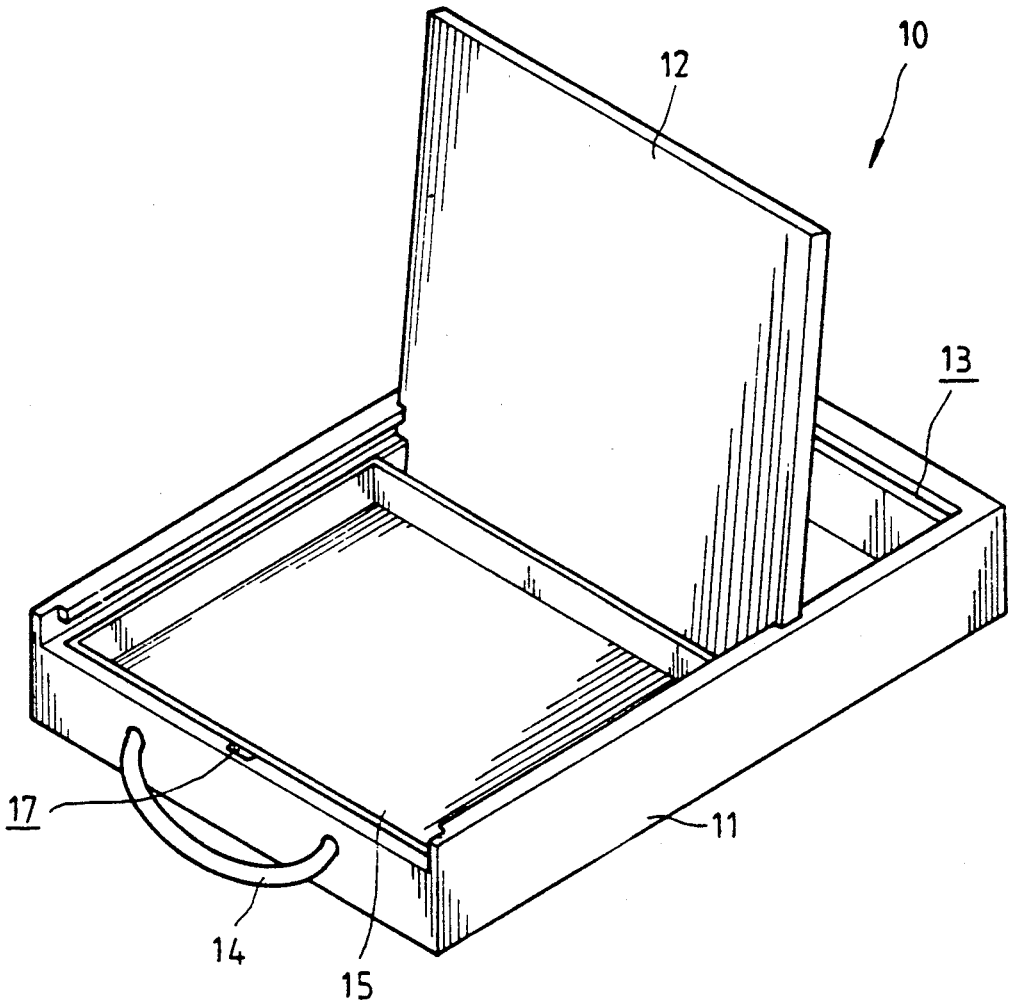
FIG. 3 is a perspective view showing the use of the removable lid as a painting board.
Figure 4:
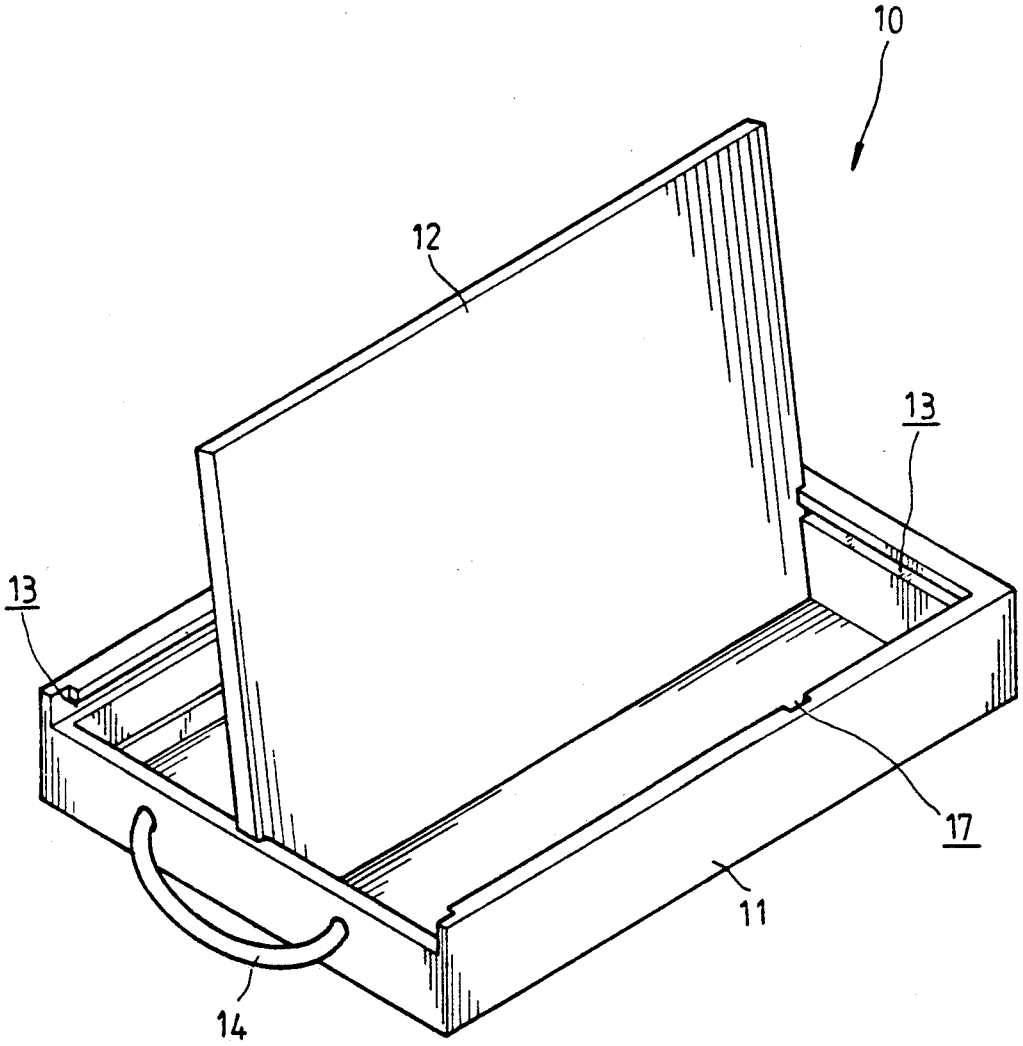
FIG. 4 is also a perspective view showing another embodiment of using the removable lid as a painting board.

On each pair of opposing lateral sides of the casing 11, a pair of supporting slots 17, each pair being opposing each other, are respectively formed. The supporting slots 17 are inclined in such a way that when the flat lid 12 is slidably guided thereinto, it is in an appropriate inclined position for painting, as shown in FIGS. 3 and 4. It is to be understood that other kinds of supporting means can also be applied herein to replace the slots 17. In this way, an easel can be constructed.

It is apparent that although the invention has been described in connection with the preferred embodiment, it is contemplated that those skilled in the art may make changes to certain features of the preferred embodiment without altering the overall basic function and concept of the invention and without departing from the spirit and scope of the invention as defined in the appended claims.

What is claimed is:

1. A portable easel suitcase comprising a casing having a bottom, a top, a front, a back and lateral sides connected between the top and the bottom, said top being opened to receive therein a tool holder for storing painting tools therein, and closable with a removable lid, said tool holder being so sized and shaped to be supported by steps formed on the lateral sides of the casing and to partially cover the bottom, supporting means being formed on the lateral sides in such a way to support a drawing board in an inclined position suitable for painting when the lid is removed from the casing, said lid being flat and the drawing board being constituted thereby and the supporting means comprising a plurality of pairs of inclined slots respectively formed on opposing front, back and lateral sides, each slot in the pair of inclined slots being opposed to each other to slidably receive therein the flat lid.

2. A portable easel suitcase as claimed in claim 1 wherein said drawing board is made of a transparent material.

3. A portable easel suitcase as claimed in claim 2 wherein said transparent material is acrylic.

4. A portable easel suitcase as claimed in claim 1 wherein said drawing board is coated with a black board surface.

5. A portable easel suitcase as claimed in claim 1 wherein said drawing board is coated with a smooth and shining white board surface for oil-based marking pens.

6. A portable easel suitcase as claimed in claim 1 wherein the casing is a parallelepiped having a first dimension less than a second and a third dimensions thereof, said second and third dimensions constituting the top and bottom of the casing and wherein said tool holder is a rectangular shallow pan-like member with a height about half of the first dimension of the casing, a length about half of one of the second and the third dimensions of the casing and a width about the same as the other one of the second and third dimensions of the casing so as to be supported by said steps.

* * * * *